US005752356A

United States Patent [19]

Miklavic et al.

[11] Patent Number: 5,752,356

[45] Date of Patent: May 19, 1998

[54] DETACHABLE WALL TRIM

[76] Inventors: Thomas D. Miklavic; Terry Miklavic, both of 1316 Templeton Run Rd., Claysville, Pa. 15232

[21] Appl. No.: 767,306

[22] Filed: Dec. 16, 1996

[51] Int. Cl.[6] ..... E04C 2/38

[52] U.S. Cl. ..... 52/718.02; 52/288.1; 52/511; 52/512

[58] Field of Search ..... 52/288.1, 718.02, 52/511, 512

[56] References Cited

U.S. PATENT DOCUMENTS

| | | | |
|---|---|---|---|
| 2,082,668 | 6/1937 | Vanderveld | 52/718.02 |
| 3,508,371 | 4/1970 | Meyer | 52/718.02 |
| 3,894,377 | 7/1975 | Welch . | |

*Primary Examiner*—Christopher Kent
*Attorney, Agent, or Firm*—Carothers & Carothers

[57] ABSTRACT

A detachable wall trim having an elongated section of decorative wall trim with a coextending recess channel on the back face. Two or more spaced fastener clips are received in the channel. These clips are formed of one piece plates having spaced screws for holding them or securing them within the channel on the back face of the trim. A key-hole shaped screw head retaining slot is provided in each of these plates and each key-hole slot has a screw head access opening with a narrower screw shaft slot extending therefrom for slidably receiving a screw shaft without permitting passage of the screw head through the screw shaft slot. The wall screws are first fastened to the wall and properly aligned with the clips and then the screw heads extending from the wall are permitted to sufficiently extend from the wall so that they pass through the key hole slots to retain the trim on the wall where desired. These clips are adapted for 360° orientation within the channels so that the detachable trim may be applied at any desired orientation on a ceiling or wall.

3 Claims, 2 Drawing Sheets

DETACHABLE WALL TRIM

BACKGROUND OF THE INVENTION

This invention relates to wall trim or molding and more particularly to detachable wall trim or molding.

Conventional wall trim or molding is utilized in most all building structures as decorative trim applied around windows, doorways, at floor level and at the juncture of the ceiling and walls.

When painting rooms which have decorative trim, generally the ceilings, walls and the wall trim are all painted different colors and therefore a great amount of care is required to prevent paint being undesirably applied to an adjacent wrong surface, such that paint is undesirably spattered or brushed onto adjoining wall trim, walls, or ceiling.

In order to prevent this and to provide an easy and convenient method for painting the different room surfaces, such as the walls, ceilings and trim, the wall trim of the present invention is made so that it is readily detachable and reattachable for separate painting, cleaning etc.

SUMMARY OF THE INVENTION

The detachable wall trim of the present invention includes an elongated section of decorative wall trim for securement about a window or door opening, along the base of the wall as a baseboard, or at the top as ceiling molding or trim. The elongated wall trim is provided with a coextending recessed channel on the back face and at least two spaced fastener clips are received in this channel. These clips are each comprised of a one-piece plate having spaced means for securing, as with screws, each plate to the trim in the back channel. A key-hole shaped screw head retaining slot is provided on the clip between the securing means. This slot has a screw head access opening with a narrow screw shaft slot extending therefrom for slidably receiving a screw shaft without permitting passage of a screw head through the screw shaft slot.

These plates are adapted for 360° orientation within the back channel. In other words, the plates, or clips formed by the plates, may be oriented any direction desired within the channel and are adapted in size such that they can be turned and mounted within the channel to any desired orientation. This permits the wall trim to be detachably secured to a wall at any desired orientation or location.

In one embodiment, the bottom of the back channel of the wall trim is provided with a screw head clearance recess that is aligned under the key-hole shaped slot for providing screw head clearance for a screw head when it is passed through the screw head access opening of the plate making up the clip.

In a second variation or embodiment, the plates making up the clips have a raised portion positioned between the spaced securing points used for securing the plate to the channel bottom. In this embodiment, the key-hole shaped retaining slot providing screw head clearance is provided in this raised portion thereby providing adequate screw head clearance between the raised portion of the clip and the bottom of the back channel of the trim.

BRIEF DESCRIPTION OF THE DRAWINGS

Other objects and advantages appear in the following description and claims.

The accompanying drawings show, for the purpose of exemplification, without limiting the invention or claims thereto, certain practical embodiments of the present invention wherein:

DETAILED DESCRIPTION OF THE PREFERRED EMBODIMENTS

Figure 1:
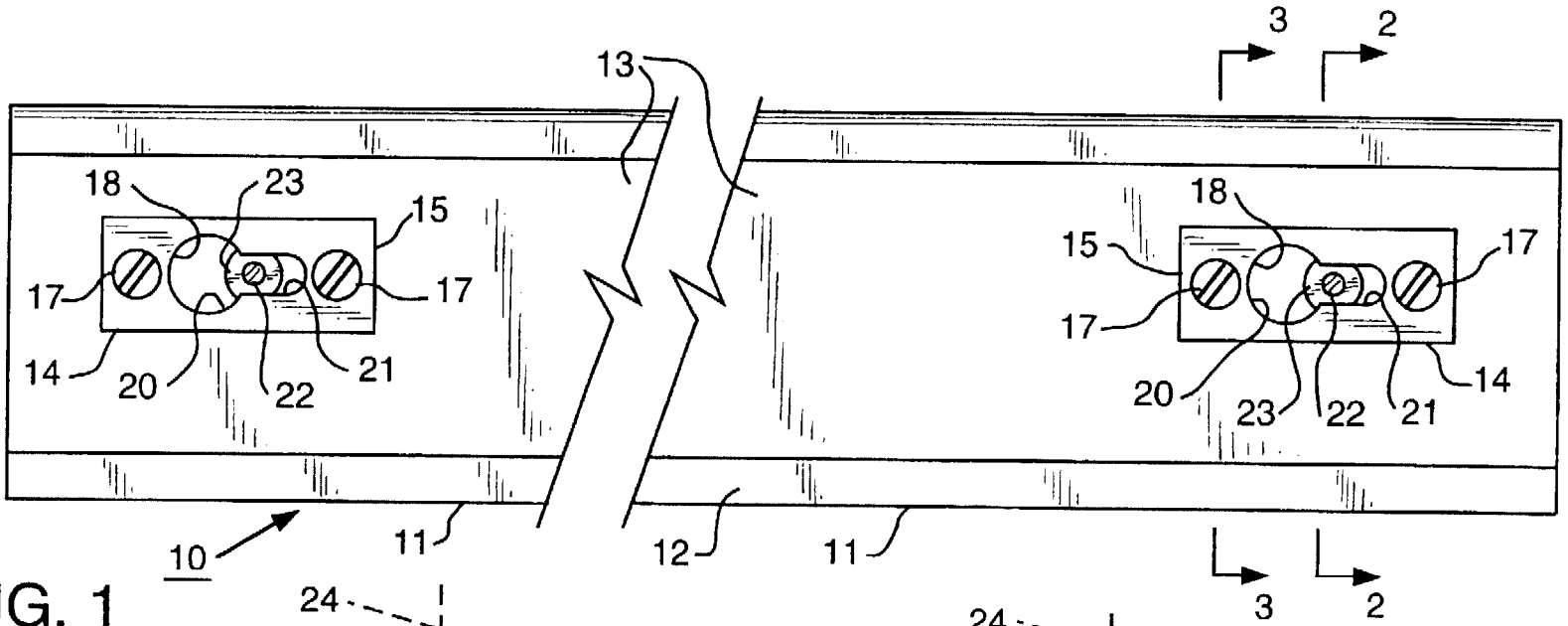
FIG. 1 is a view in rear elevation of one embodiment of the detachable wall trim of the present invention.
Figure 2:
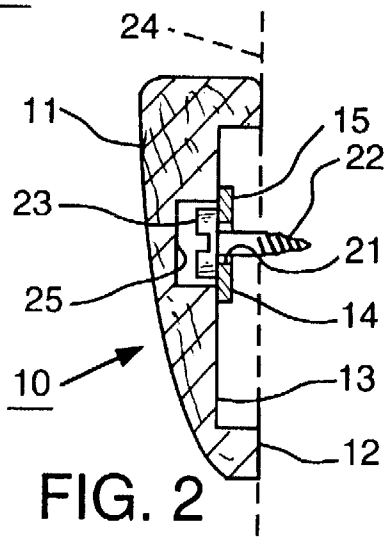
FIG. 2 is a view in vertical cross section taken along section line 2—2 of FIG. 1.
Figure 3:
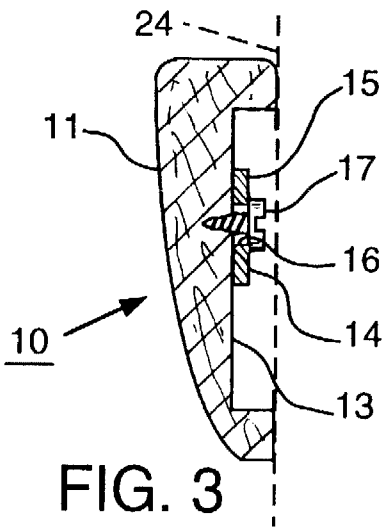
FIG. 3 is a view in vertical cross section taken along line 3—3 of FIG. 1.

Referring to FIGS. 1, 2 and 3, the detachable wall trim 10 is comprised of an elongated section of decorative wall trim 11 which is provided on its back face 12 with a coextending recess channel 13.

As can be seen in the cross sections of FIGS. 2 and 3, the decorative trim 11 in this instance is what is conventionally referred to as ranch molding constructed of wood. However, it should be realized that the decorative cross sectional shape of the elongated molding trim 11 may be of any desired decorative configuration and may be constructed of any suitable material, such as wood, plastic or metal.

Two spaced fastener clips 14 are received in back channel 13. These clips 14 are each comprised of a one piece plate 15 having spaced openings 16 therethrough receiving wood screws 17, which provide spaced means for securing plate 15 to trim 11 in the channel 13.

A key-hole shaped screw head retaining slot 18 is provided in plate 15 between securing screws 17. Slot 18 is provided with a screw head access opening 20 and a narrower screw shaft slot 21 extending therefrom for slidably receiving a screw shaft 22 without permitting passage of the screw head 23 through screw shaft slot 21. Screw shafts 22 are first properly prepositioned relative to clips 14 and then screwed into the wall 24 with the heads 23 thereof left sufficiently spaced from wall 24 so that they will just pass through respective screw head clearance openings 20. Once this is accomplished, then the entire detachable trim 10 may be slid to the side such that the screw shafts 22 slide into narrower slots 21, such that the trim will now be held securely in place on wall 24 as screw heads 23 cannot pass through the narrower shaft slots 21 of plates 15.

It should be noted that the length of the plates 15 making up each of the clips 14 is sufficiently short such that plates 15 or clips 14 can be even oriented vertically, or 90° from their position shown in FIG. 1. In this regard, reference may be had to FIG. 4 to illustrate the different orientation described.

Referring again to FIGS. 1, 2 and 3, this adaptation permits the clips 14 to have 360° orientation within channel 13, and this in turn permits the detachable trim 10 to the readily adapted to be mounted on any vertical wall or horizontal ceiling at any desired orientation.

A screw head clearance recess 25 is provided in channel 13 and is aligned under said key-hole shaped slot 18 in order to provide adequate screw head clearance for screw head 23, as best illustrated in FIG. 2, to permit screw head 23 to pass through opening 20.

Figure 4:
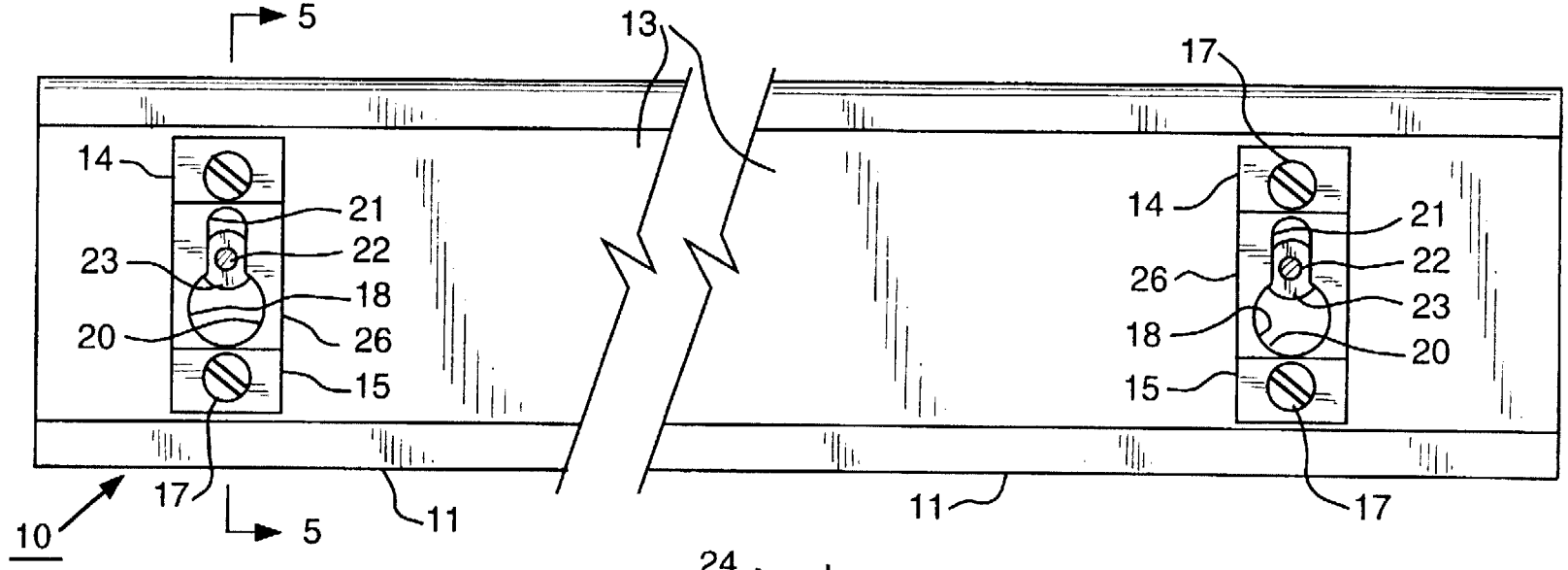
FIG. 4 is a view in rear elevation of a second embodiment of the detachable trim of the present invention.
Figure 5:
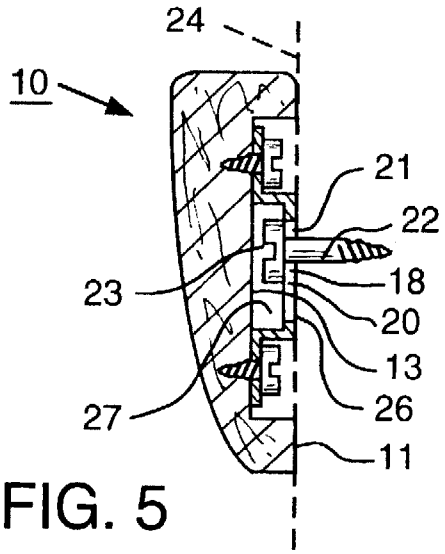
FIG. 5 is a view in vertical cross section taken along section line 5—5 of FIG. 4.

Referring to FIGS. 4 and 5, in this embodiment, plates 14 have raised portions 26 provided between end screws 17 and the key-hole shaped retaining slot 18 is provided in this raised portion 26. This in turn provides screw head clearance 27 between raised portion 26 and the bottom of channel 13 as is best illustrated in FIG. 5.

This embodiment eliminates the need to provide additional screw head access clearance recesses 25 in the bottom of channel 13 as required with the embodiment shown in FIGS. 1, 2 and 3. This clip configuration shown in FIGS. 4 and 5 is similar to the clip shown in Welch U.S. Pat. No. 3,894,377 for FASTENER CLIP, and the teachings shown therein may also be incorporated in clip 14 of the present invention.

With the ability of clips 14 to be oriented in any direction desired within channel 13, it may be readily observed that detachable trim 11 may be secured at any position of vertical or horizontal orientation on a wall or ceiling by first attaching the screw shafts 22 to the wall (after being properly positioned relative to clips 14) and then simply slipping the screw heads 23 through respective screw head access openings 20 of key-hole slots 18 and then sliding the entire trim 11 such that the screw shafts 22 are retained in the narrower portions 21 of the key-hole slots.

We claim:

1. Detachable wall trim comprising; an elongated section of decorative wall trim having a coextending recess channel on a back face thereof, and at least two spaced fastener clips received in said channel, said clips each comprised of a one-piece plate having spaced means for securing said plate to said trim in said channel and a key-hole shaped screw head retaining slot between said securing means, said slot having a screw head access opening with a narrower screw shaft slot extending therefrom for slidably receiving a screw shaft without permitting passage of a screw head through said screw shaft slot, said plates adapted for 360° orientation in said channel, and a screw head clearance recess in said channel and aligned under said key-hole shaped slot for providing screw head clearance for a screw head to be passed through said screw head access opening.

2. The detachable wall trim of claim 1, wherein said plates are adapted for 360° orientation in said channel before securement therein.

3. The detachable wall trim of claim 1, said plates having a raised portion positioned between said spaced means for securing and containing said key-hole shaped retaining slot for providing screw head clearance between said raised portion and said channel.

* * * * *